US012575651B2

(12) United States Patent
Luo

(10) Patent No.: US 12,575,651 B2
(45) Date of Patent: Mar. 17, 2026

(54) UMBRELLA

(71) Applicant: Tempo Manufacturing LLC, Nantong (CN)

(72) Inventor: Xiong Luo, Nantong (CN)

(73) Assignee: Tempo Manufacturing LLC, Nantong (CN)

( * ) Notice: Subject to any disclaimer, the term of this patent is extended or adjusted under 35 U.S.C. 154(b) by 257 days.

(21) Appl. No.: 18/391,978

(22) Filed: Dec. 21, 2023

(65) Prior Publication Data

US 2024/0260724 A1 Aug. 8, 2024

(30) Foreign Application Priority Data

Feb. 6, 2023 (CN) ..... 202310094491.X

(51) Int. Cl.

| | |
|---|---|
| ***A45B 25/10*** | (2006.01) |
| ***A45B 19/00*** | (2006.01) |
| ***A45B 23/00*** | (2006.01) |
| ***A45B 25/08*** | (2006.01) |

(52) U.S. Cl.

CPC ..... *A45B 25/10* (2013.01); *A45B 19/00* (2013.01); *A45B 23/00* (2013.01); *A45B 25/08* (2013.01); *A45B 2019/004* (2013.01); *A45B 2023/0037* (2013.01)

(58) Field of Classification Search

CPC ..... A45B 25/10
USPC ..... 135/29
See application file for complete search history.

(56) References Cited

U.S. PATENT DOCUMENTS

| | | | | |
|---|---|---|---|---|
| 1,264,075 | A * | 4/1918 | Hout | A45B 25/02 135/29 |
| 2,385,575 | A * | 9/1945 | Isler | A45B 25/02 135/29 |
| 7,614,413 | B1 * | 11/2009 | Ma | A45B 25/02 135/31 |
| 9,192,215 | B2 * | 11/2015 | Ma | A45B 25/06 |
| 2003/0015231 | A1 * | 1/2003 | Ma | A45B 25/10 135/33.6 |
| 2006/0000498 | A1 * | 1/2006 | Liu | A45B 19/04 135/25.4 |
| 2007/0056615 | A1 * | 3/2007 | Lai | A45B 19/08 135/25.4 |
| 2009/0071518 | A1 * | 3/2009 | Amsel | A45B 25/14 135/29 |

* cited by examiner

*Primary Examiner* — Noah Chandler Hawk
(74) *Attorney, Agent, or Firm* — Wang Law Firm, Inc.

(57) ABSTRACT

An umbrella has a column, an upper nest, a movable lower nest, a plurality of long rods, a plurality of short rods. The upper nest has a plurality of first slots spaced apart on a periphery of the upper nest, a plurality of first pins is disposed on the upper nest respectively; each long rod has a first rod-hanging hook on the top end thereof, each first rod-hanging hook hooks on the corresponding first pin; the lower nest has a plurality of second slots spaced apart on a periphery of the lower nest, a plurality of second pins are disposed on the lower nest respectively; each short rod has a second rod-hanging hook on the bottom end thereof, each second rod-hanging hook hooks on the corresponding second pin. The structure of the present invention is simple and reasonable, the machining is convenient and the cost is low.

7 Claims, 12 Drawing Sheets

UMBRELLA

TECHNICAL FIELD OF THE INVENTION

The present invention relates to a field of umbrellas, and in particular to an umbrella which is convenient and quick to assemble.

BACKGROUND OF THE INVENTION

As an outdoor leisure appliance, an umbrella is widely used in leisure places such as a piazza, a beach, a park, and a yard, etc., and provides a comfortable cooling space for people. The structure of an existing umbrella generally consists of an umbrella column, an umbrella frame and umbrella cloth; the umbrella frame is connected to a top of the umbrella column, the umbrella column mainly serves to support the umbrella frame, the umbrella cloth is connected to the umbrella frame to prop open the umbrella frame, and then the umbrella cloth is also propped open along with the umbrella frame, so that the umbrella is opened; wherein the umbrella frame comprises an upper nest, a lower nest, long rods and short rods, the upper nest is fixed to the top end of the umbrella column, the lower nest is disposed encircling the umbrella column, the upper ends of the long rods are mounted on the upper nest, the lower ends of the short rods are mounted on the lower nest, and the upper ends of the short rods are hinged to the middle parts of the long rods. In the existing structure, rods connect the upper nest/lower nest in such a manner that the upper nest/lower nest has grooves for fixing the rods, the rods are connected to the grooves, and are bound by using iron wires to fix the rods. Such a mounting structure is complicated in operation and low in efficiency, and if one of the rods is damaged, the rods are inconvenient to be replaced.

After searching, a Chinese Patent CN201663981U (patent No. 201020107572) discloses "Connecting Structure between Nests and Rods", featuring a gear-shaped grooves for nesting and fixing rods, protruding members are disposed on two sides of each grooved gear flap to nest a rod connecting piece, and side opening grooves with a height approximately equal to the height of the protruding members are respectively disposed on two sides of the head of the rod connecting piece. The connecting structure enables the nest to be rotatably connected to the rods, and facilitates production, mounting and removal operations. However, the connecting structure is only limited to the connection between the nest and the rods, and does not improve the assembly of the nest and the umbrella column; moreover, although rapid assembly of the rods and the nest can be realized, the connection is not stable enough, and the rods are easy to fall off.

SUMMARY OF THE INVENTION

It is an object of the present invention to provide an umbrella with a simple and reasonable structure and being convenient to assemble and disassemble.

For achieving the above object, the umbrella comprises a column having a top end; an upper nest disposed on the top end of the column; a movable lower nest disposed encircling the column; a plurality of long rods having a top end and a middle portion; a plurality of short rods having a top end and a bottom end; wherein, the upper nest has a plurality of first slots spaced apart on a periphery of the upper nest for receiving the long rods, a plurality of first pins is disposed on the upper nest respectively running through each first slot; the lower nest has a plurality of second slots spaced apart on a periphery of the lower nest for receiving the short rods, a plurality of second pins is disposed on the lower nest respectively running each second slot.

Preferably, each long rod has a first rod-hanging hook on the top end thereof, each first rod-hanging hook hooks on the corresponding first pin so as to rotatably connect each long rod to the upper nest; each short rod has a second rod-hanging hook on the bottom end thereof, each second rod-hanging hook hooks on the corresponding second pin so as rotatably connect each short rod to the lower nest, the top end of each short rod is hinged to the middle portion of the corresponding long rod.

Preferably, the upper nest has a central hole extending downward for receiving the top end of the column and a circular connecting segment located at a center and a top of the upper nest with a vertical tapered through hole which has an upper portion for receiving a cap and a lower portion; an annular groove extending downward is defined between the periphery of the lower portion of the circular connecting segment and an inner wall of the central hole for positioning the column; the upper nest has an elastic buckle protruding from the inner wall of the central hole, and the column has a corresponding clamping groove at the periphery of the top end of the column for clamping the elastic buckle, the top end of the column is connected to the upper nest when the elastic buckle clamps with the clamping groove.

Preferably, the long rod has a connecting portion at the top of the long rod fitting with each first slot of the upper nest, a head of the connecting portion is arc-shaped for facilitating rotation, the first rod-hanging hook is arranged on the connecting portion and opens upward and inclines towards the head of the connecting portion; each short rod has a connecting end at the bottom of each short rod fitting with each second slot of the lower nest, a head of the connecting end is arc-shaped for facilitating rotation, and the second rod-hanging hook is arranged on the connecting end and opens downward and inclines towards the head of the connecting end.

Preferably, each long rod and short rod has two ends, each long rod and short rod has a rod-hanging hook at one end thereof which hooks first and second pins in the corresponding first and second slots, the long rod and the short rod are respectively sleeved on the first and second pins via the rod-hanging hook, so as to rotatably connect to the upper nest and the lower nest, respectively.

Preferably, the rod-hanging hook is integrated with the long rod or the short rod, when the top end of the long rod and the bottom end of the short rod are bent to form a U-shaped connecting structure, the rod-hanging hook of each long rod opens upward and inclines towards the head of the connecting portion, and the rod-hanging hook of each short rod opens downward and inclines towards the head of the connecting end.

Preferably, when the rod-hanging hook is separated from the long rod or the short rod, wire connectors are sleeved on the top end of each long rod and on the bottom end of each short rod, and the rod-hanging hooks are arranged on heads of the wire connectors.

Preferably, the middle portion of the long rod is sleeved with a connecting head having a lower end, the connecting head has a connecting lug protruding from the lower end of the connecting head, a connecting sleeve head fitting with the connecting head is sleeved on the top end of the short rod; a U-shaped connecting portion connected to the connecting lug is arranged at an end of the connecting sleeve head, short shafts protrude from two sides of the connecting lug, the U-shaped connecting portion has corresponding shaft holes at two sides of the U-shaped connecting portion, and the short rod is hinged to the middle portion of the long rod by connecting the short shafts to the shaft holes.

Preferably, a stop collar for locking the lower nest when opening the umbrella is arranged at an upper portion of the column, a button fitting with the stop collar is mounted in the lower nest, the lower nest has an upper segment, a middle segment and a lower segment, a diameter of the upper segment is consistent with a diameter of the middle segment, each second slot for mounting each short rod is arranged on the upper segment, the lower segment is a tapered cylindrical structure fitting with the column, the button is ring-shaped and is mounted in the middle segment of the lower nest, a lower end of the button abuts against a flange of the lower nest, and an upper end of the button is limited by a clamping ring, the button has a hand-pressing portion protruding from the button, and the button has a raised locking block located opposite the hand-pressing portion on an inner wall of the button, the lower nest has an opening for exposing the hand-pressing portion of the button, the button has a recess corresponding to the raised locking block, and a spring is supported between the recess and the inner wall of the lower nest, urging the button away from the raised locking block, and the clamping ring is an elastic clamping ring, the clamping ring has one or more circular clamping columns protruding at a periphery of the clamping ring, the lower nest has corresponding clamping column holes at the inner wall of the lower nest, and the clamping ring is fixed in the lower nest by fitting between the circular clamping column and the clamping column hole.

Preferably, a spring button protrudes from an external surface of the stop collar, a clamping hole receiving the spring button is arranged on the column, the stop collar is positioned by fitting the spring button to the clamping hole, the stop collar has a limiting step fitting with the spring button, a bump protrudes from an internal surface of the stop collar, the bump has a positioning hole at an end of the bump, a corresponding pressing point protrudes from the inner wall of the column, and the stop collar abuts against the positioning hole of the bump via the pressing point, and a clamping groove fitting with the locking block is recessed at the surface of the stop collar, and when the lower nest moves upward, the locking block of the button is clamped into the clamping groove of the stop collar and locked with the stop collar so as to open the umbrella.

Preferably, the column comprises an upper column and a lower column, the upper column is capable of being separated from the lower column, the upper column and the lower column are connected together by a threaded connecting member, the threaded connecting member has a circular positioning hole at a periphery of the threaded connecting member, the lower column has a corresponding protruding point at an outer wall of the lower column, and the threaded connecting member is inserted into the lower column and is fixed by slotting the circular positioning hole onto the protruding point.

Preferably, a circular connecting column matched with the circular connecting segment of the upper nest protrudes from a lower end of the cap, a buckle is arranged at a lower end of the circular connecting column, the cap is inserted into the circular connecting segment of the upper nest at the circular connecting column, and clamps with the lower end of the circular connecting segment by the buckle.

Preferably, the connection between the cap and the upper nest is not limited to a buckle connection, and may also be a threaded connection or connection by using a screw.

Compared with the prior art, the advantages of the present invention lie in that: the rods and the upper nest/the lower nest are connected when the rod-hanging hooks clamps the first and second pins; the assembly is convenient and quick, the rod-hanging hook is designed at a specific angle to facilitate the assembly, and after the assembly is completed, the angle is turned around, so that the rods and the upper nest/the lower nest are buckled without falling off, and are stable and reliable after assembly; the rods can be made of wires, which are convenient to form and have a relatively low cost; and the top nest is fixed to the umbrella column when the elastic buckle clamps with the clamping groove, so that the operation is convenient and labor-saving. The structure of the present invention is simple and reasonable, the assembly and connection of various components are all convenient and quick, and the structure is stable and reliable after assembly; moreover, the machining is convenient and the cost is low, thereby facilitating disassembly and maintenance.

DETAILED DESCRIPTION OF THE INVENTION

Figure 1:
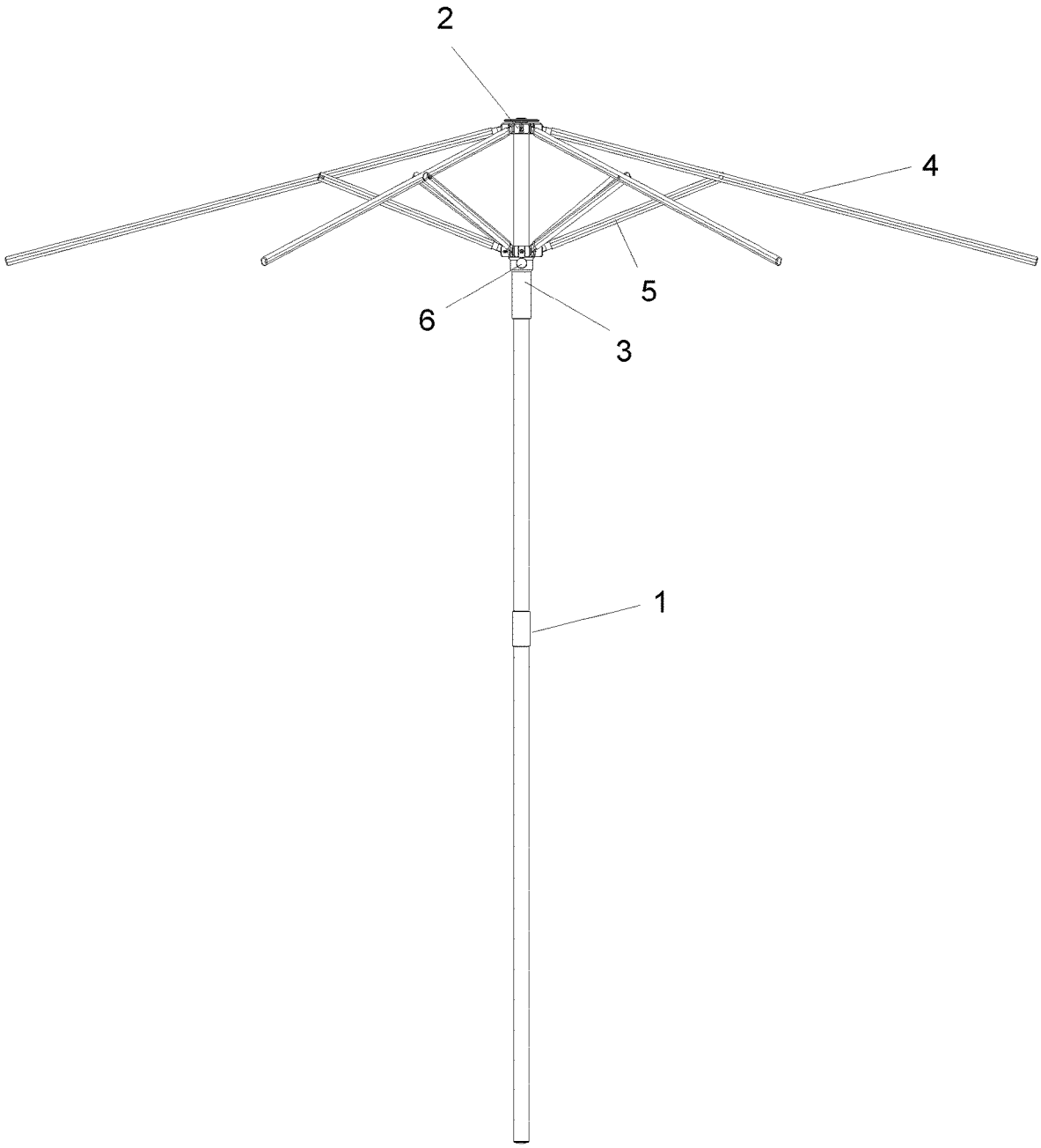
FIG. 1 is a perspective view of an umbrella according to Embodiment 1 of the present invention.
Figure 2:
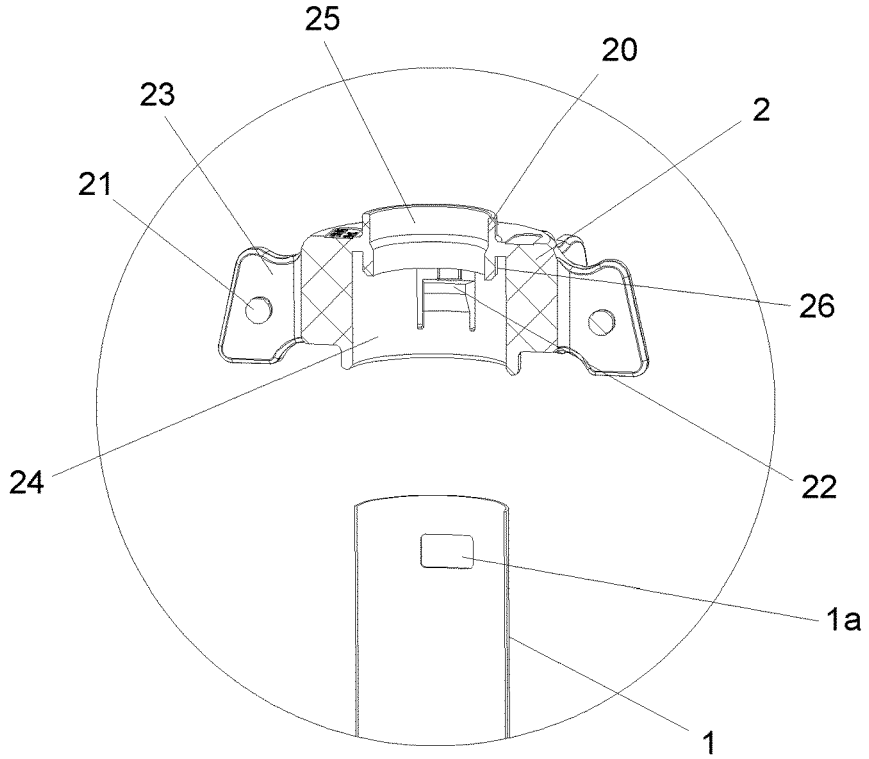
FIG. 2 is an enlarged sectional view of an upper nest and a column when they are separated according to Embodiment 1 of the present invention.
Figure 3:
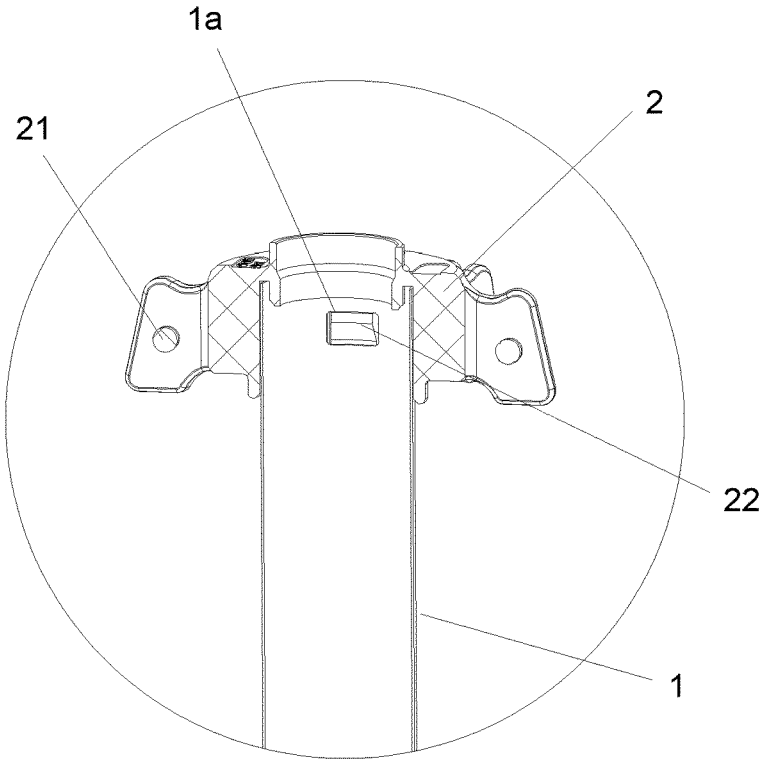
FIG. 3 is a sectional view of the upper nest connected to the column according to Embodiment 1 of the present invention.

The present invention will be further described below in detail by embodiments with reference to the accompanying drawings.

Embodiment 1

FIGS. 1-14 show a first preferred embodiment of the umbrella of the present invention. The umbrella comprises a column 1, an upper nest 2, a movable lower nest 3, a plurality of long rods 4 and a plurality of short rods 5; the top end of the column 1 is connected to the upper nest 2 when an elastic buckle 22 clamps with the clamping groove 1*a*; the upper nest 2 has a plurality of first slots 23 spaced apart on a periphery of the upper nest 2 for receiving the long rods 4, a plurality of first pins 21 is disposed on the upper nest 2 respectively running through each first slot 23; each long rod 4 has a first rod-hanging hook 41 on the top end thereof, each first rod-hanging hook 41 hooks on the corresponding first pin 21 so as to rotatably connect each long rod 4 to the upper nest 2; the lower nest 3 has a plurality of second slots 34 spaced apart on a periphery of the lower nest 3 for receiving the short rods 5, a plurality of second pins 31 are disposed on the lower nest 3 respectively running each second slot 34; each short rod 5 has a second rod-hanging hook 51 on the bottom end thereof, each second rod-hanging hook 51 hooks on the corresponding second pin 31 so as rotatably connect each short rod 5 to the lower nest 3, the top end of each short rod 5 is hinged to the middle portion of the corresponding long rod 4.

Figure 11:
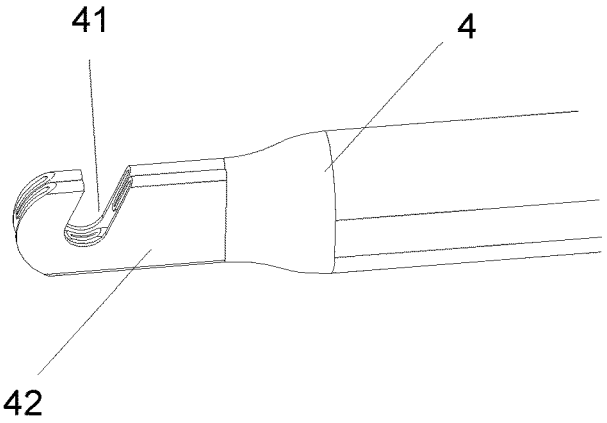
FIG. 11 is a perspective view of a part of a rod according to Embodiment 1 of the present invention.
Figure 12:
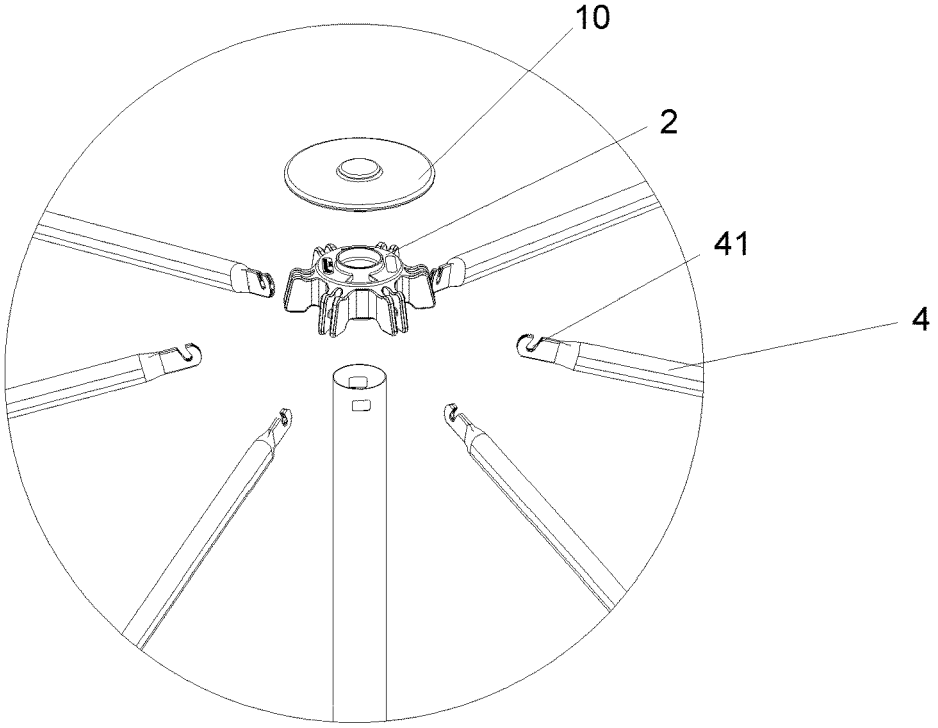
FIG. 12 is an exploded view of long rods, the upper nest and the column according to Embodiment 1 of the present invention.
Figure 13:
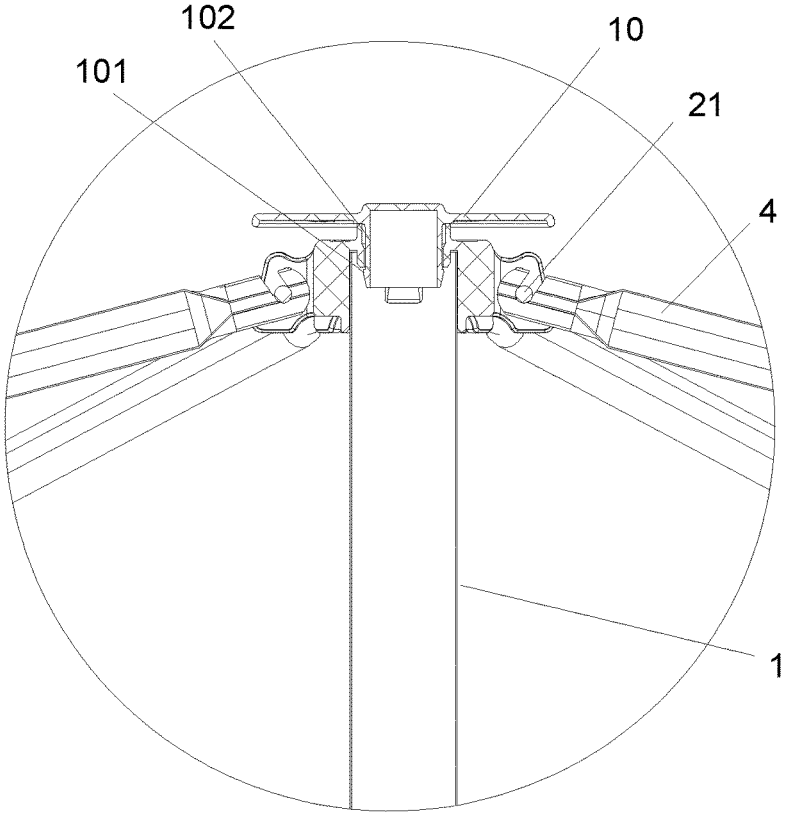
FIG. 13 is a sectional view of the long rods and the upper nest when they are assembled together according to Embodiment 1 of the present invention.
Figure 14:
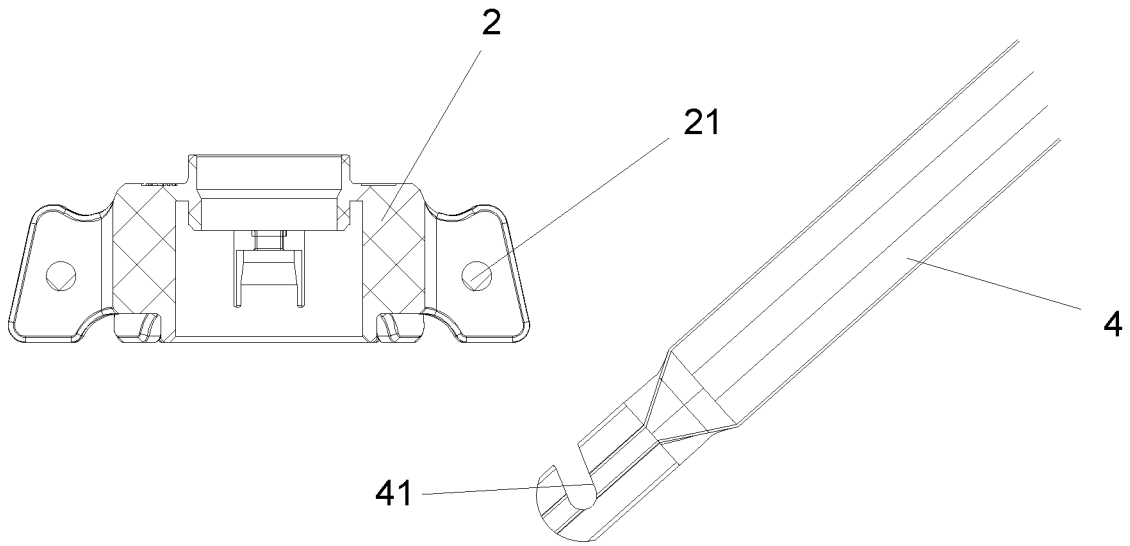
FIG. 14 is a sectional view of the long rod and the upper nest when they are separated according to Embodiment 1 of the present invention.
Figure 17:
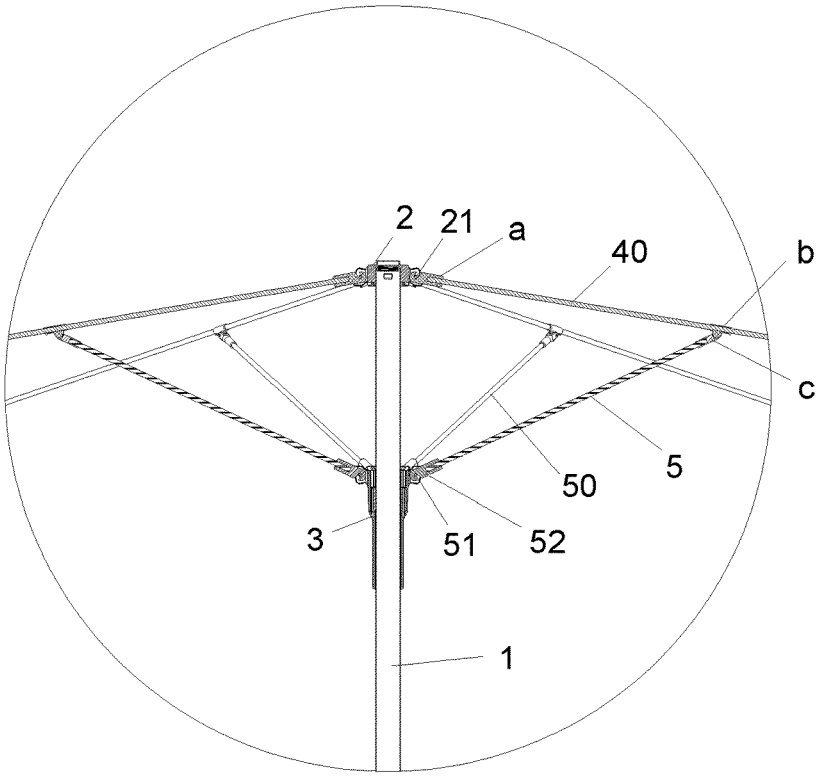
FIG. 17 is a sectional view of the umbrella with long rods when it is open according to Embodiment 2 of the present invention.

The specific structure is as follows: the upper nest 2 has a central hole 24 extending downward for receiving the top end of the column 1 and a circular connecting segment 20 located at a center and a top of the upper nest 2 with a vertical tapered through hole 25 which has an upper portion for receiving a cap 10 and a lower portion; an annular groove 26 extending downward is defined between the periphery of the lower portion of the circular connecting segment 20 and an inner wall of the central hole 24 for positioning the column 1; the upper nest 2 has the elastic buckle 22 protruding from the inner wall of the central hole 24, and the column 1 has a corresponding clamping groove 1*a* at the periphery of the top end of the column 1 for clamping the elastic buckle 22, the top end of the column 1 is connected to the upper nest 2 when the elastic buckle 22 clamps with the clamping groove 1*a*. The long rod 4 has a connecting portion 42 at the top of the long rod 4 fitting with each first slot 23 of the upper nest 2, a head of the connecting portion 42 is arc-shaped for facilitating rotation, the first rod-hanging hook 41 is arranged on the connecting portion 42 and opens upward and inclines towards the head of the connecting portion 42, as shown in FIG. 11; the long rod 4 has a connecting portion 42 at the top of the long rod 4 fitting with each first slot 23 of the upper nest 2, a head of the connecting portion 42 is arc-shaped for facilitating rotation, the first rod-hanging hook 41 is arranged on the connecting portion 42 and opens upward and inclines towards the head of the connecting portion 42, as shown in FIG. 17. The connecting portion 42 of the long rod 4 is integrated with the long rod 4 and the connecting end 52 of the short rod 5 is integrated with the short rod 5, and they may also be connected and fixed by using a separate structure, respectively. Both the inclination angles and the lengths of the first and the second rod-hanging hooks 41, 51 are specially designed, so that the long rods 4 and the short rods 5 can be conveniently assembled, and are not easy to come off after assembling.

A stop collar 8 for locking the lower nest 3 when opening the umbrella is arranged at an upper portion of the column 1, a button 6 fitting with the stop collar 8 is mounted in the lower nest 3, the lower nest 3 has an upper segment, a middle segment and a lower segment, a diameter of the upper segment is consistent with a diameter of the middle segment, each second slot 34 for mounting each short rod 5 is arranged on the upper segment, the lower segment is a tapered cylindrical structure fitting with the column 1, the button 6 is ring-shaped and is mounted in the middle segment of the lower nest 3, a lower end of the button 6 abuts against a flange of the lower nest 3, and an upper end of the button 6 is limited by a clamping ring 7, the button 6 has a hand-pressing portion 61 protruding from the button 6, and the button 6 has a raised locking block 62 located opposite the hand-pressing portion 61 on an inner wall of the button 6, the lower nest 3 has an opening 33 for exposing the hand-pressing portion 62 of the button 6, the button 6 has a recess 63 corresponding to the raised locking block 62, and a spring 9 is supported between the recess 63 and the inner wall of the lower nest 3, urging the button 6 away from the raised locking block 62, and the clamping ring 7 is an elastic clamping ring, the clamping ring 7 has one or more circular clamping columns 71 protruding at a periphery of the clamping ring 7, the lower nest 3 has corresponding clamping column holes 32 at the inner wall of the lower nest 3, and the clamping ring 7 is fixed in the lower nest 3 by fitting between the circular clamping column 71 and the clamping column hole 32.

Figure 4:
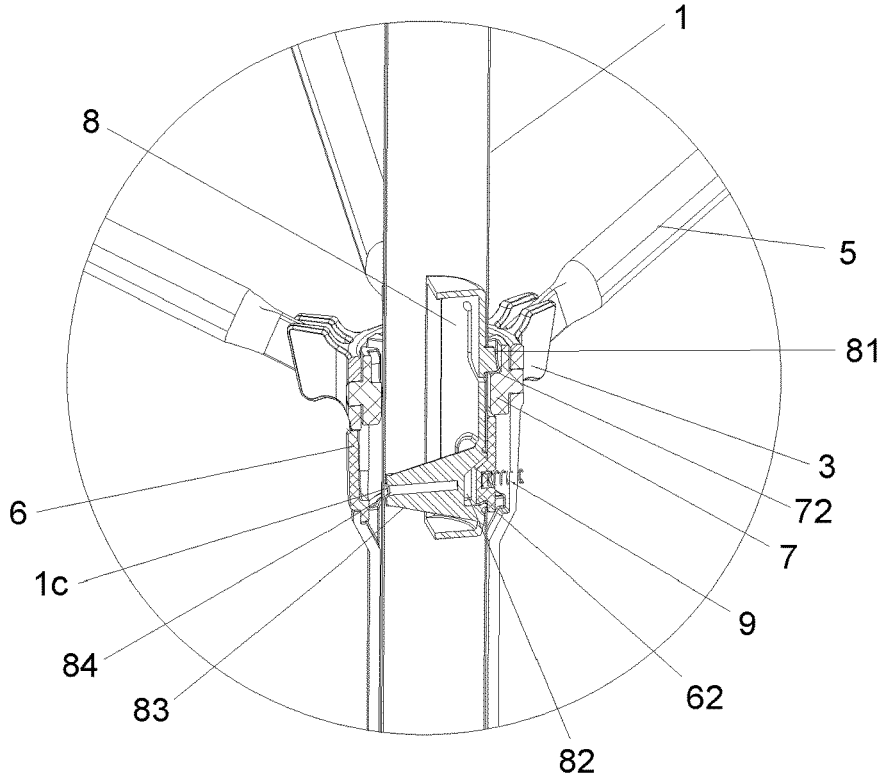
FIG. 4 is a sectional view of a lower nest connected to the column according to Embodiment 1 of the present invention.
Figure 5:
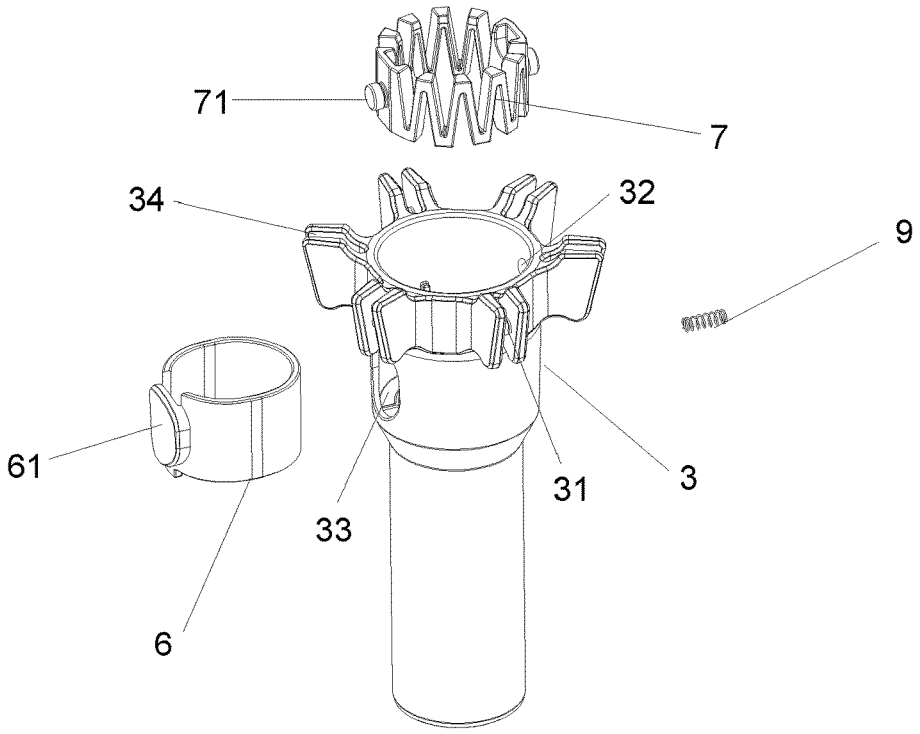
FIG. 5 is an exploded view of the lower nest according to Embodiment 1 of the present invention.
Figure 6:
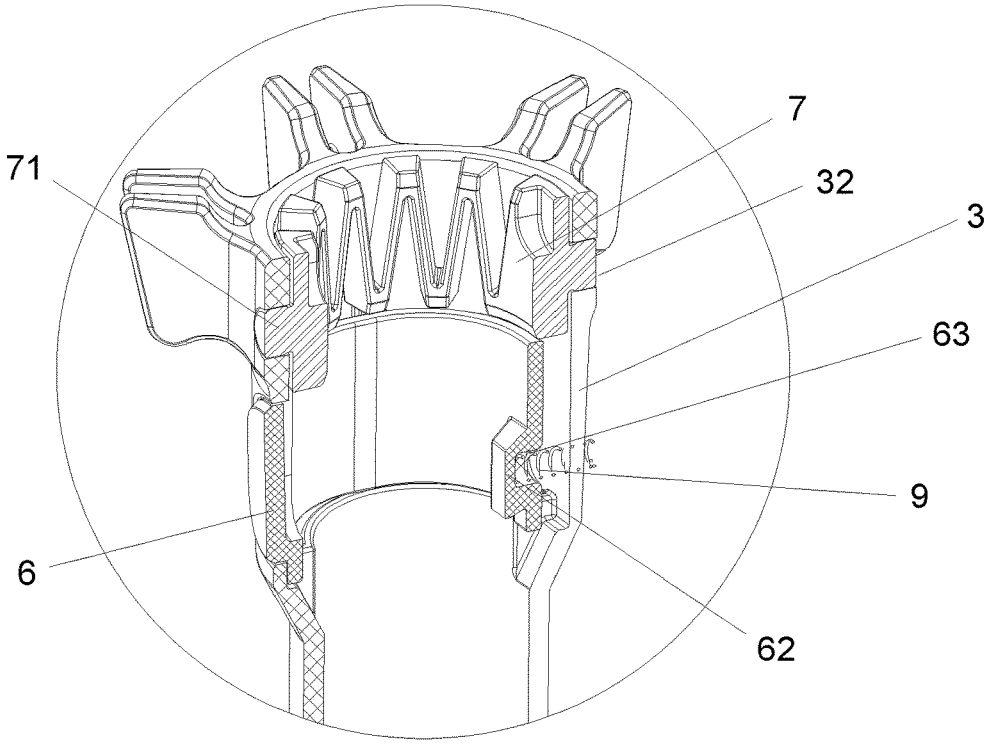
FIG. 6 is a perspective view of the lower nest with a portion of the lower nest cutting off according to Embodiment 1 of the present invention.
Figure 7:
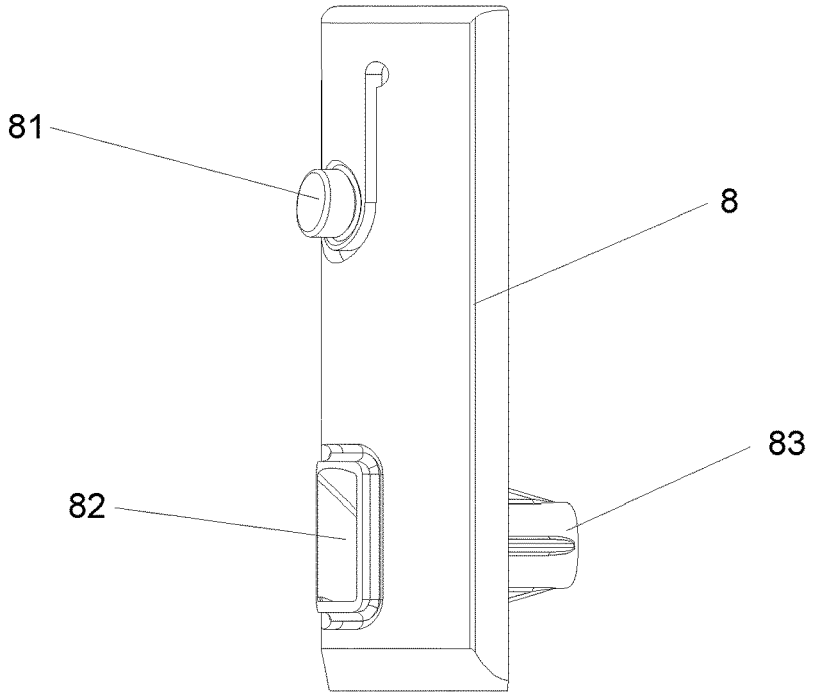
FIG. 7 is a perspective view of a stop collar according to Embodiment 1 of the present invention.
Figure 8:
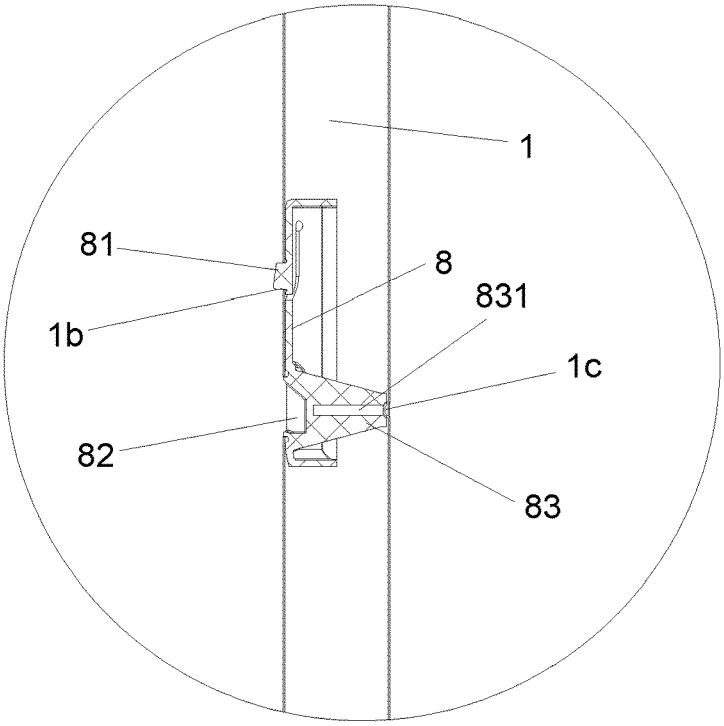
FIG. 8 is a sectional view of the stop collar connected to the column according to Embodiment 1 of the present invention.
Figure 9:
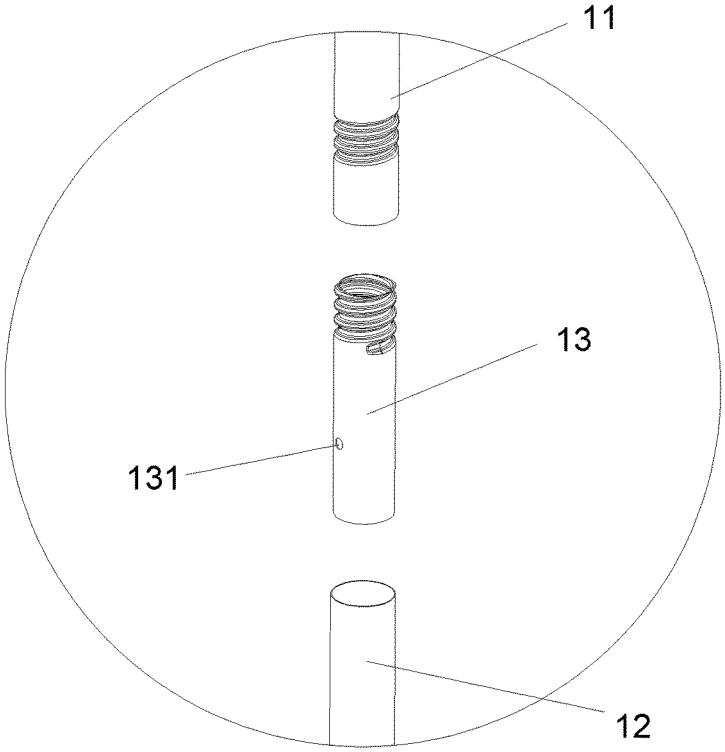
FIG. 9 is an exploded view of a part of the column according to Embodiment 1 of the present invention.
Figure 10:
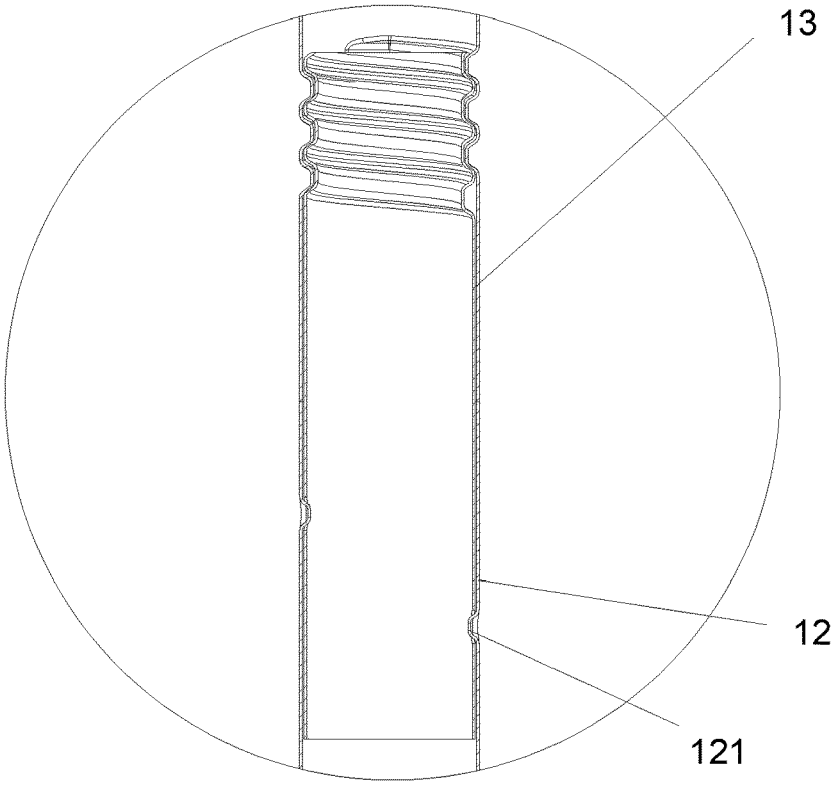
FIG. 10 is a sectional view of a threaded connecting member connected to a lower column according to Embodiment 1 of the present invention.

As shown in FIG. 4, a spring button 81 protrudes from an external surface of the stop collar 8, a clamping hole 1*b* receiving the spring button 81 is arranged on the column 1; a bump 83 protrudes from an internal surface of the stop collar 8, the bump 83 has a positioning hole 831 at an end of the bump 83, a corresponding pressing point 1*c* protrudes from the inner wall of the column 1; the stop collar 8 is positioned by fitting the spring button 81 to the clamping hole 1*b*, and the stop collar 8 abuts against the positioning hole 831 of the bump 83 via the pressing point 1*c*, so that the assembly is very stable and reliable. The stop collar 8 has a limiting step 72 fitting with the spring button 81, and a clamping groove 82 fitting with the locking block 62 is recessed at the surface of the stop collar 8, and when the lower nest 3 moves upward, the locking block 62 of the button 6 is clamped into the clamping groove 82 of the stop collar 8 and locked with the stop collar 8 so as to open the umbrella.

The column 1 in Embodiment 1 comprises an upper column 11 and a lower column 12, the upper column 11 is capable of being separated from the lower column 12, the upper column 11 and the lower column 12 are connected together by a threaded connecting member 13, the threaded connecting member 13 has a circular positioning hole 131 at a periphery of the threaded connecting member 13, the lower column 12 has a corresponding protruding point 121 at an outer wall of the lower column 12, and the threaded connecting member 13 is inserted into the lower column 12 and is fixed by slotting the circular positioning hole 131 onto the protruding point 121. The threaded connecting member 13 has an external thread on an upper end of the threaded connecting member 13, the upper column 11 has a corresponding internal thread at a lower end of the upper column 11, and the threaded connecting member 13 and the upper column 11 are connected and fixed by the threads.

A circular connecting column 102 matched with the circular connecting segment 20 of the upper nest 2 protrudes from a lower end of the cap 10, a buckle 101 is arranged at a lower end of the circular connecting column 102, the cap 10 is inserted into the circular connecting segment 20 of the upper nest 2 at the circular connecting column 102, and clamps with the lower end of the circular connecting segment 20 by the buckle 101.

When opening the umbrella, the lower nest 3 is pushed up until the limiting step 72 on the clamping ring 7 abuts against the spring button 81 on the stop collar 8, and the umbrella is in a maximum opening state; at the same time, the button 6 moves to the left under the action of the spring 9, and the hand-pressing portion 62 at the right side of the button 6 also moves to the left so as to be clamped in the clamping groove 82, so that the lower nest 3 is locked and cannot move downwards, thereby achieving umbrella opening.

When closing the umbrella, the button 6 is pressed to enable the hand-pressing portion 62 to move to the right and to be disengaged from the clamping groove 82, so that the lower nest 3 is unlocked, thereby completing closing of the umbrella.

Embodiment 2

FIGS. 15-19 show a second preferred embodiment of the umbrella of the present invention. The umbrella comprises a column 1, an upper nest 2, a movable lower nest 3, a plurality of long rods 40 and a plurality of short rods 50. Each long rod 40 and short rod 50 is made of special wires and has two ends, each long rod 40 and short rod 50 has a rod-hanging hook 401 at one end thereof which hooks first and second pins 21, 31 in the corresponding first and second slots 23, 34, the long rod 40 and the short rod 50 are respectively sleeved on the first and second pins 21, 31 via the rod-hanging hook 401, so as to rotatably connect to the upper nest 2 and the lower nest 3, respectively.

Figure 15:
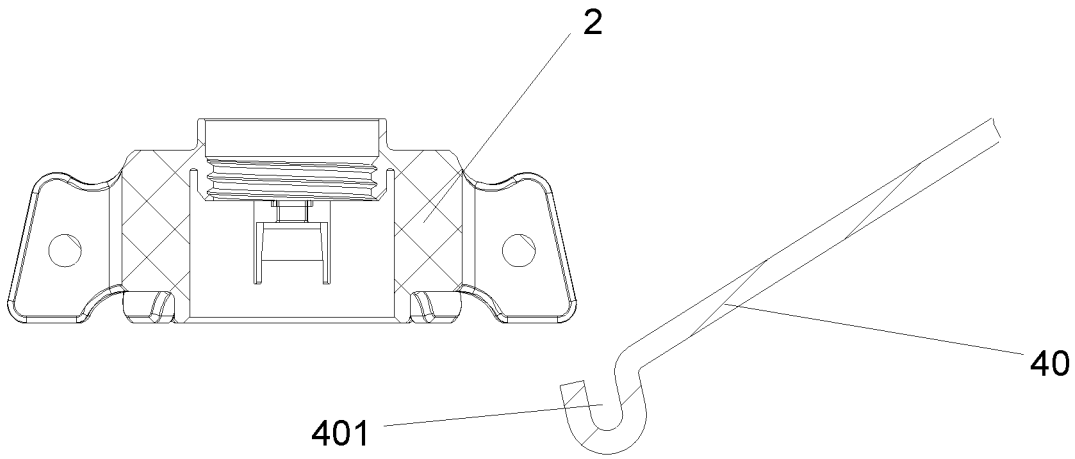
FIG. 15 is a sectional view of a long rod and an upper nest when they are separated according to Embodiment 2 of the present invention.
Figure 16:
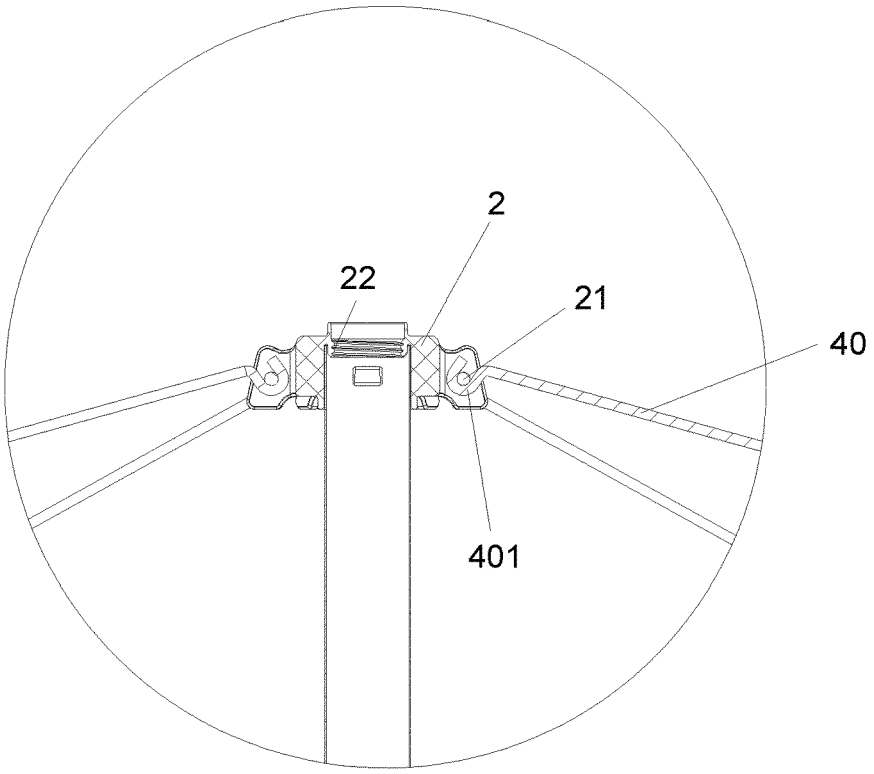
FIG. 16 is a sectional view of the long rod and the upper nest when they are assembled together according to Embodiment 2 of the present invention.

The rod-hanging hook 401 is integrated with the long rod 40 or the short rod 50, as shown in FIGS. 15-16, when the top end of the long rod 40 and the bottom end of the short rod 50 are bent to form a U-shaped connecting structure, the rod-hanging hook 401 of each long rod 40 opens upward and inclines towards the head of the connecting portion 42, and the rod-hanging hook 401 of each short rod 50 opens downward and inclines towards the head of the connecting end 52. The main principle of the rod-hanging hooks 401 is the same as that of the first and second rod-hanging hooks 41, 51 in Embodiment 1: both the inclination angle and the length thereof are specially designed, so that the long rods 40 and the short rods 50 can be conveniently assembled, and are not easy to come off after assembling.

Figure 18:
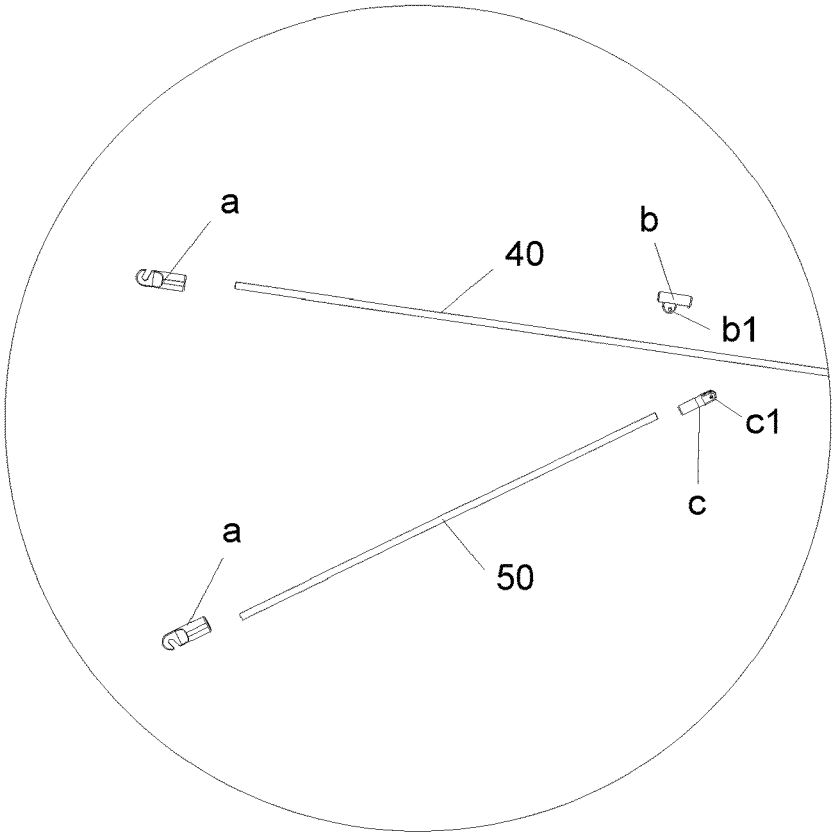
FIG. 18 is an exploded view of a long rod and a short rod according to Embodiment 2 of the present invention.
Figure 19:
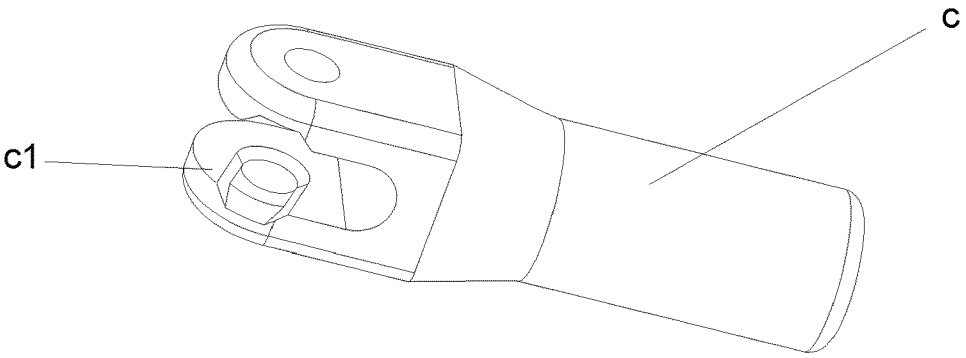
FIG. 19 is a perspective view of a connecting sleeve head according to Embodiment 2 of the present invention.

As shown in FIGS. 17-19, when the rod-hanging hook 401 is separated from the long rod 40 or the short rod 50, wire connectors a are sleeved on the top end of each long rod 40 and on the bottom end of each short rod 50, and the rod-hanging hooks 401 are arranged on heads of the wire connectors a. The middle portion of the long rod 40 is sleeved with a connecting head b having a lower end, the connecting head b has a connecting lug b1 protruding from the lower end of the connecting head b, a connecting sleeve head c fitting with the connecting head b is sleeved on the top end of the short rod 50; a U-shaped connecting portion c1 connected to the connecting lug b is arranged at an end of the connecting sleeve head c, short shafts protrude from two sides of the connecting lug b1, the U-shaped connecting portion c1 has corresponding shaft holes at two sides of the U-shaped connecting portion c1, and the short rod 50 is hinged to the middle portion of the long rod 40 by connecting the short shafts to the shaft holes.

The difference between the umbrella in Embodiment 2 and that in Embodiment 1 further lies in a mounting method of the cap 10. In Embodiment 2, the upper nest 2 has an internal thread on a circular connecting segment 20, the cap 10 has a corresponding external thread on a circular connecting column, and the cap 10 is inserted into the circular connecting segment 20 of the lower nest 3 through the circular connecting column, and is fixed to the upper nest 2 by means of a threaded connection.

The cap 10 and the upper nest 2 may also be connected by using a screw.

Embodiment 3

Figure 20:
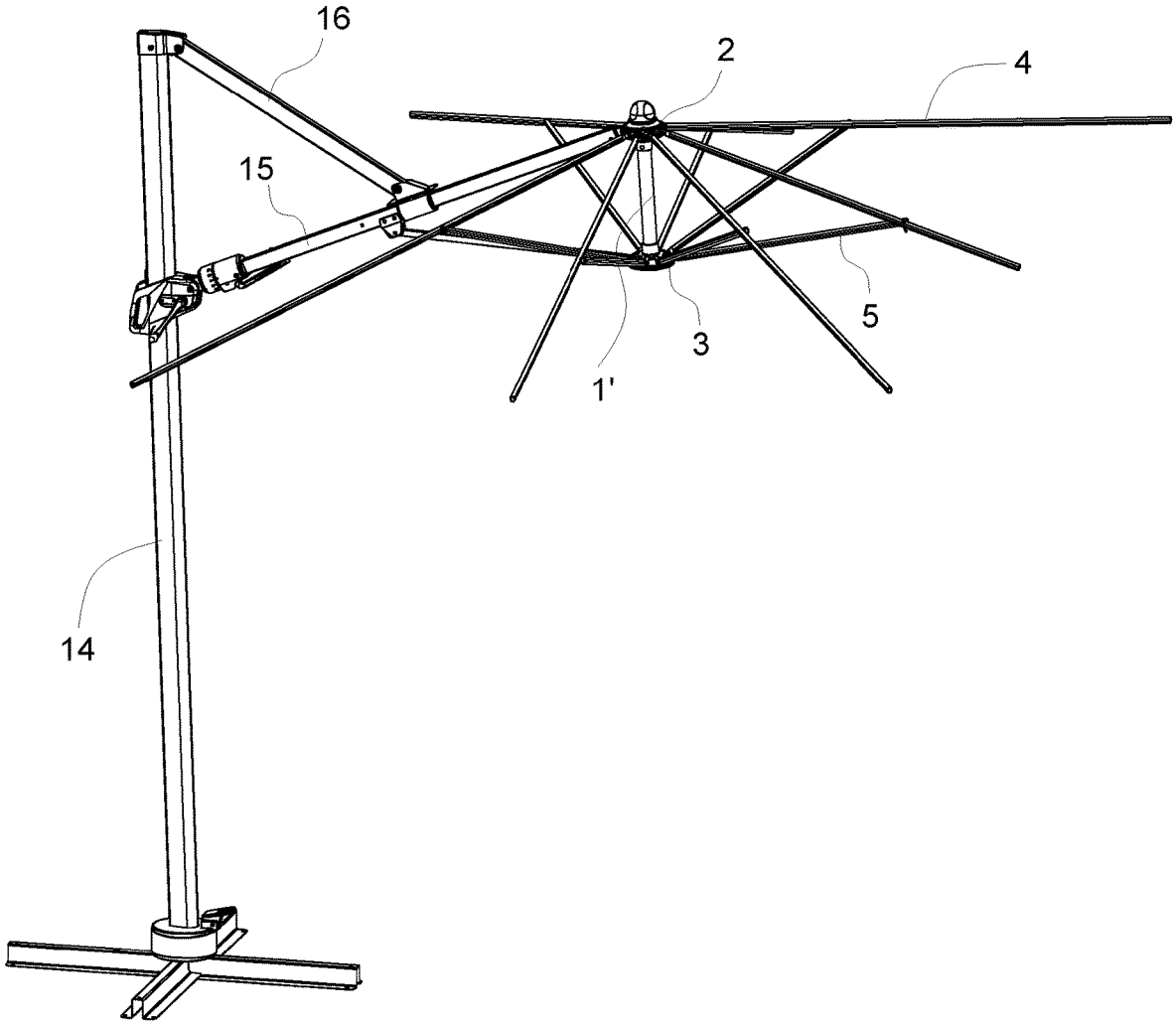
FIG. 20 is a perspective view of an umbrella when long rods and short rods are unfolded (the umbrella is open) according to Embodiment 3 of the present invention.
Figure 21:
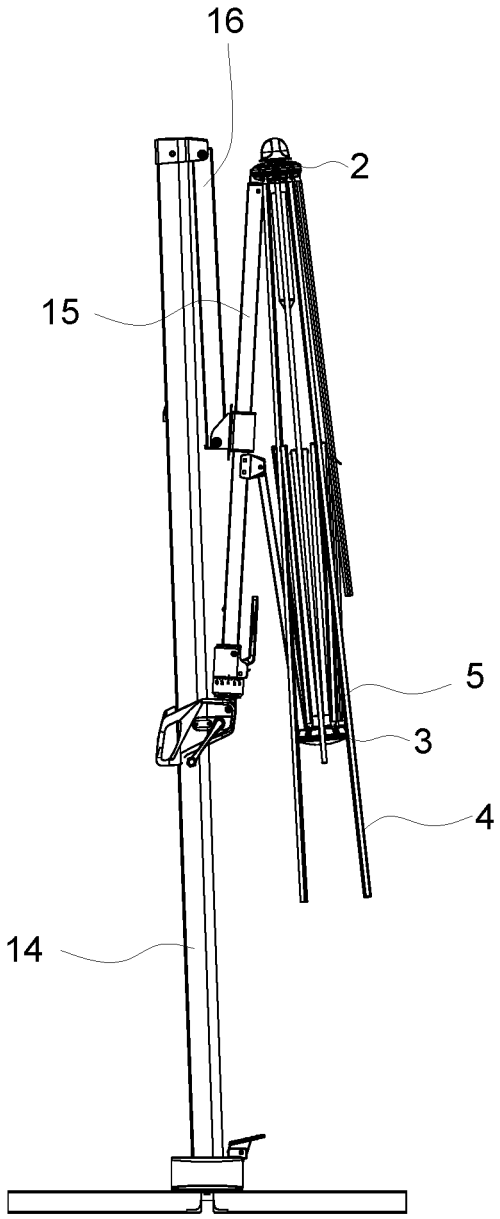
FIG. 21 is a perspective view of the umbrella when long rods and short rods are folded (the umbrella is close) according to Embodiment 3 of the present invention.

FIGS. 20-21 show a third preferred embodiment of the umbrella of the present invention. The umbrella in Embodiment 3 is a hanging umbrella, comprising an umbrella pillar 14, a plurality of traverse rods 15, a plurality of tilted rods 16, a column 1', an upper nest 2, a lower nest 3, a plurality of long rods 4, a plurality of short rods 5. The difference between the umbrella in Embodiment 3 and that in Embodiment 1 lies in that the column 1' is an integrated piece and cannot be divided into an upper column and a lower column.

The protection scope of the present invention is not limited to each embodiment described in this description. Any changes and replacements made on the basis of the scope of the present invention patent and of the description shall be included in the scope of the present invention patent.

The invention claimed is:

1. An umbrella, comprising:

a column having a top end;

an upper nest disposed on the top end of the column;

a movable lower nest disposed encircling the column;

a plurality of long rods having a top end and a middle portion;

a plurality of short rods having a top end and a bottom end;

wherein, the upper nest has a plurality of first slots spaced apart on a periphery of the upper nest for receiving the long rods, a plurality of first pins is disposed on the upper nest respectively running through each first slot;

the upper nest has a central hole extending downward for receiving the top end of the column and a circular connecting segment located at a center and a top of the upper nest with a vertical tapered through hole which has an upper portion for receiving a cap and a lower portion;

an annular groove extending downward is defined between the periphery of the lower portion of the circular connecting segment and an inner wall of the central hole for positioning the column;

the upper nest has an elastic buckle protruding from the inner wall of the central hole, and the column has a corresponding clamping groove at the periphery of the top end of the column for clamping the elastic buckle, the top end of the column is connected to the upper nest when the elastic buckle clamps with the clamping groove;

the lower nest has a plurality of second slots spaced apart on a periphery of the lower nest for receiving the short rods, a plurality of second pins is disposed on the lower nest respectively running each second slot.

2. The umbrella of claim 1, wherein each long rod has a first rod-hanging hook on the top end thereof, each first rod-hanging hook hooks on the corresponding first pin so as to rotatably connect each long rod to the upper nest;

each short rod has a second rod-hanging hook on the bottom end thereof, each second rod-hanging hook hooks on the corresponding second pin so as to rotatably connect each short rod to the lower nest, the top end of each short rod is hinged to the middle portion of the corresponding long rod.

3. The umbrella of claim 1, wherein the middle portion of the long rod is sleeved with a connecting head having a lower end, the connecting head has a connecting lug protruding from the lower end of the connecting head, a connecting sleeve head fitting with the connecting head is sleeved on the top end of the short rod;

a U-shaped connecting portion connected to the connecting lug is arranged at an end of the connecting sleeve head, short shafts protrude from two sides of the connecting lug, the U-shaped connecting portion has corresponding shaft holes at two sides of the U-shaped connecting portion, and the short rod is hinged to the middle portion of the long rod by connecting the short shafts to the shaft holes.

4. The umbrella of claim 1, wherein a stop collar for locking the lower nest when opening the umbrella is arranged at an upper portion of the column, a button fitting with the stop collar is mounted in the lower nest, the lower nest has an upper segment, a middle segment and a lower segment, a diameter of the upper segment is consistent with a diameter of the middle segment, each second slot for mounting each short rod is arranged on the upper segment, the lower segment is a tapered cylindrical structure fitting with the column, the button is ring-shaped and is mounted in the middle segment of the lower nest, a lower end of the button abuts against a flange of the lower nest, and an upper end of the button is limited by a clamping ring, the button has a hand-pressing portion protruding from the button, and the button has a raised locking block located opposite the hand-pressing portion on an inner wall of the button, the lower nest has an opening for exposing the hand-pressing portion of the button, the button has a recess corresponding to the raised locking block, and a spring is supported between the recess and the inner wall of the lower nest, urging the button away from the raised locking block, and the clamping ring is an elastic clamping ring, the clamping ring has one or more circular clamping columns protruding at a periphery of the clamping ring, the lower nest has corresponding clamping column holes at the inner wall of the lower nest, and the clamping ring is fixed in the lower nest by fitting between the circular clamping column and the clamping column hole.

5. The umbrella of claim 4, wherein a spring button protrudes from an external surface of the stop collar, a clamping hole receiving the spring button is arranged on the column, the stop collar is positioned by fitting the spring button to the clamping hole, the stop collar has a limiting step fitting with the spring button, a bump protrudes from an internal surface of the stop collar, the bump has a positioning hole at an end of the bump, a corresponding pressing point protrudes from the inner wall of the column, and the stop collar abuts against the positioning hole of the bump via the pressing point, and a clamping groove fitting with the locking block is recessed at the surface of the stop collar, and when the lower nest moves upward, the locking block of the button is clamped into the clamping groove of the stop collar and locked with the stop collar so as to open the umbrella.

6. The umbrella of claim 1, wherein the column comprises an upper column and a lower column, the upper column is capable of being separated from the lower column, the upper column and the lower column are connected together by a threaded connecting member, the threaded connecting member has a circular positioning hole at a periphery of the threaded connecting member, the lower column has a corresponding protruding point at an outer wall of the lower column, and the threaded connecting member is inserted into the lower column and is fixed by slotting the circular positioning hole onto the protruding point.

7. The umbrella of claim 1, wherein a circular connecting column matched with the circular connecting segment of the upper nest protrudes from a lower end of the cap, a buckle is arranged at a lower end of the circular connecting column, the cap is inserted into the circular connecting segment of the upper nest at the circular connecting column, and clamps with the lower end of the circular connecting segment by the buckle.

* * * * *